US008928255B2

(12) United States Patent
Lopez et al.

(10) Patent No.: US 8,928,255 B2
(45) Date of Patent: Jan. 6, 2015

(54) DYNAMIC STEP DIMMING INTERFACE

(71) Applicants: Arturo Hernandez Lopez, Apodaca (MX); Markus Ziegler, Watertown, MA (US); Carlos Daniel Ortega Jaramillo, San Nicolás de los Garza (MX)

(72) Inventors: Arturo Hernandez Lopez, Apodaca (MX); Markus Ziegler, Watertown, MA (US); Carlos Daniel Ortega Jaramillo, San Nicolás de los Garza (MX)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 14/189,359

(22) Filed: Feb. 25, 2014

(65) Prior Publication Data

US 2014/0252970 A1 Sep. 11, 2014

Related U.S. Application Data

(60) Provisional application No. 61/774,556, filed on Mar. 7, 2013.

(51) Int. Cl.
*H05B 37/02* (2006.01)
*H05B 41/42* (2006.01)

(52) U.S. Cl.
CPC ..... *H05B 37/02* (2013.01); *H05B 41/42* (2013.01); *Y10S 315/04* (2013.01)
USPC ..... 315/307; 315/224; 315/DIG. 4

(58) Field of Classification Search
CPC .... H05B 37/00; H05B 37/02; H05B 37/0281; H05B 33/00; H05B 33/02; H05B 33/08; H05B 33/0803; H05B 33/0896
USPC ..... 315/291, 307, 308, 224, DIG. 4, DIG. 5, 315/209 R, 360
See application file for complete search history.

(56) References Cited

U.S. PATENT DOCUMENTS

| | | | | |
|---|---|---|---|---|
| 6,507,157 | B1 | 1/2003 | Erhardt et al. | |
| 7,843,141 | B1 | 11/2010 | Xiong et al. | |
| 8,067,904 | B2 | 11/2011 | Lin et al. | |
| 8,294,379 | B2 * | 10/2012 | Liu et al. | 315/224 |
| 2004/0061452 | A1 * | 4/2004 | Konopka et al. | 315/209 R |
| 2005/0122057 | A1 * | 6/2005 | Chen et al. | 315/224 |
| 2011/0025228 | A1 | 2/2011 | Van Elk et al. | |
| 2011/0074302 | A1 * | 3/2011 | Draper et al. | 315/224 |

* cited by examiner

*Primary Examiner* — David H Vu
(74) *Attorney, Agent, or Firm* — Shaun P. Montana

(57) ABSTRACT

A dynamic step dimming interface is provided that allows a ballast to energize a lamp in a dim mode or a normal mode. The ballast includes a lamp controller that energizes the lamp using an oscillating current. The oscillating current is also provided to a voltage monitor, which indicates the voltage level of the oscillating current, and to a rectifier, which provides an output indicative of the oscillating current. The rectifier is responsive to user input indicating whether the dim mode or the normal mode is to be used. A processing circuit receives the voltage level from the voltage monitor and provides a mode command to the ballast, indicating the lamp mode, based on inputs received, and provides a reference voltage to a comparator. The comparator receives the rectifier output and the reference voltage, and generates a voltage indicative of a power level of the lamp for the processing circuit.

18 Claims, 11 Drawing Sheets

DYNAMIC STEP DIMMING INTERFACE

CROSS-REFERENCE TO RELATED APPLICATION

The present application claims priority of U.S. Provisional Application No. 61/774,556, filed Mar. 7, 2013 and entitled "DYNAMIC STEP DIMMING INTERFACE", the entire contents of which are hereby incorporated by reference.

TECHNICAL FIELD

The present invention relates to lighting, and more specifically, to electronics for lighting.

BACKGROUND

A typical step dimming interface for an electronic ballast or other lighting power device utilizes a high-impedance network and an integrator filter to measure a source voltage. The step dimming interface allows the device to energize and/or operate a lamp connected thereto at one or more pre-determined dimming levels. The device is able to step between different dimming levels based on, for example, user input.

SUMMARY

Unfortunately, a typical step dimming interface is not always robust enough to provide step dimming functionality in noisy environments. Frequently, these interfaces provide diminished results because they integrate low and high frequency noise. When such step dimming interfaces are exposed to noise, the integrator filter is not robust enough to filter out the noise. Thus, a typical step dimming interface provides a diminished step dimming capability when exposed to noisy environments. Thus, there is a need for a step dimming interface that efficiently provides noise immunity.

Embodiments of the present invention relate to a step dimming interface that provides robust noise immunity for dynamically operating a load, such as but not limited to a gas discharge lamp and/or a lamp and/or other lighting device including one or more solid state light sources (e.g., light emitting diodes, organic light emitting diodes, polymer light emitting diodes, organic light emitting compounds, etc.). In particular, the step dimming interface controls whether the lamp is operating in either a normal power mode or a dim power mode, and dynamically provides a control command to indicate whether the lamp should operate in the normal power mode or in the dim power mode.

In some embodiments, the step dimming interface is a system to be used with a voltage source producing an oscillating current. A ballast is connected to the oscillating current to energize at least one lamp and includes a lamp control circuit. The lamp control circuit receives a mode command from the step dimming interface to alter the power level applied to the lamp(s) between a level corresponding to a dim mode and a level corresponding to a normal mode. The system includes a voltage monitor with an input to receive the oscillating current and an output to indicate the voltage level of the oscillating current. The system also includes a processing circuit that has a first input connected to the output of the voltage monitor, and a first output that is connected to the lamp control circuit. The processing circuit provides a mode command to the ballast (more specifically, the lamp control circuit), indicating whether the lamp is to be energized in a dim mode or a normal mode. The processing circuit also includes a second output to provide a reference voltage that is indicative of the voltage of the oscillating current. A rectifier circuit has an input to receive the oscillating current and an output to provide rectified voltage indicative of the oscillating current. The rectifier circuit is responsive to user input that allows for selectively energizing the lamp in a dim mode and a normal mode. A comparator circuit has a first input connected to the output of the rectifier circuit, a second input connected to the processing circuit to receive the reference voltage therefrom, and an output connected to a second input of the processing circuit to provide a second voltage that is indicative of a power applied to the lamp(s). The processing circuit is responsive to the second voltage and to the voltage level output by the voltage monitor to provide the mode command.

In an embodiment, there is provided a system. The system includes: a ballast configured to be connected a source of an oscillating current and to energize a lamp, wherein the ballast comprises a lamp control circuit responsive to a mode command indicating whether the lamp will be energized in one of a dim mode and a normal mode; a voltage monitor comprising an input configured to receive the oscillating current and an output configured to indicate a voltage level of the oscillating current; a processing circuit comprising a first input connected to the output of the voltage monitor to receive the voltage level therefrom, a second input, a first output connected to the lamp control circuit to provide the mode command thereto, wherein the mode command indicates one of a dim mode and a normal mode, and a second output to provide a reference voltage indicative of the voltage level of the oscillating current; a rectifier circuit comprising an input configured to receive the oscillating current and an output configured to provide a rectified voltage indicative of the oscillating current, wherein the rectifier circuit is responsive to user input to selectively energize the lamp in one of a dim mode and a normal mode; and a comparator circuit comprising a first input connected to the rectifier circuit, a second input connected to the second output of the processing circuit, and an output connected to the second input of the processing circuit and configured to provide a compared voltage indicative of a power level applied to the lamp; wherein the processing circuit is responsive to the compared voltage provided by the comparator circuit and is responsive to voltage level indicated by the voltage monitor to provide the mode command to the ballast.

In a related embodiment, the rectifier circuit may include a resistive voltage divider circuit to limit a peak voltage of the oscillating current, and a capacitive circuit to remove high-frequency noise in the rectifier voltage. In a further related embodiment, the processing circuit may average the compared voltage over a period of time. In a further related embodiment, the period of time may be between one second and four seconds.

In another related embodiment, the processing circuit may include a time delay between receiving the compared voltage and providing the mode command indicating one of a dim mode and a normal mode. In a further related embodiment, the processing circuit may be configured to validate the user input during the time delay. In a further related embodiment, the processing circuit may be configured to validate the user input by confirming the user input during the time delay. In another further related embodiment, the time delay may be between one second and four seconds. In yet another further related embodiment, the time delay may be at least one second.

In still another related embodiment, the comparator circuit may include an auto-programmable comparator circuit including an output configured to provide one or more pulses to the second input of the processing circuit. In a further related embodiment, the processing circuit may include: a central processing unit including a first input connected to the output of the voltage monitor, a second input, a third input, a first output connected to the lamp control circuit to provide a mode command indicating that the lamp will be energize in one of a dim mode and a normal mode, and a second output to provide a reference voltage indicative of the voltage level of the oscillating current; a pulse counter including an input to receive the one or more pulses from the auto-programmable comparator circuit and an output connected to the second input of the central processing unit to provide a second voltage indicative of the state of the lamp controlled by the lamp control circuit; and a clock circuit including an output connected to the third input of the central processing unit to provide a time reference for the one or more pulses; wherein the central processing unit may be responsive to the second voltage and to the time reference to provide the mode command.

In another embodiment, there is provided a system. The system includes: a ballast configured to be connected to a source of an oscillating current and to energize a lamp, wherein the ballast comprises a lamp control circuit responsive to a mode command indicating whether the lamp will be energized in one of a dim mode and a normal mode; a voltage monitor comprising an input configured to receive the oscillating current and an output configured to indicate a voltage level of the oscillating current signal; a central processing circuit comprising a first input connected to the output of the voltage monitor, a second input, a third input, a first output connected to the lamp control circuit to provide a mode command indicating that the lamp will be energized in one of a dim mode and a normal mode, and a second output to provide a reference voltage indicative of the voltage level of the oscillating current; a rectifier circuit comprising an input configured to receive the oscillating current, an output configured to provide a rectified voltage indicative of the oscillating current, a resistive voltage divider circuit to limit a peak voltage of the oscillating current, and a capacitive circuit to remove high-frequency noise; an auto-programmable comparator circuit comprising a first input connected to the rectifier circuit, a second input connected to the second output of the central processing circuit, and an output configured to provide one or more pulses indicative of a power level applied to the lamp; a pulse counter comprising an input to receive the one or more pulses from the auto-programmable comparator circuit and an output connected to the second input of the central processing circuit to provide a second voltage indicative of the state of the lamp controlled by the lamp control circuit; and a clock circuit comprising an output connected to the third input of the central processing circuit to provide a time reference for the one or more pulses; wherein the central processing circuit is responsive to the one or more pulses and to the voltage level output by the voltage monitor to provide the mode command.

In a related embodiment, the central processing circuit may average the one or more pulses over a period of time. In a further related embodiment, the period of time may be between one second and four seconds.

In another related embodiment, the central processing circuit may include a time delay between receiving the one or more pulses and providing the mode command indicating one of a dim mode and a normal mode. In a further related embodiment, the central processing circuit may be configured to validate the user input during the time delay by confirming the user input during the time delay. In a further related embodiment, the time delay may be between one second and four seconds.

In another embodiment, there is provided a method of energizing a lamp in one of a dim mode and a normal mode. The method includes: monitoring a voltage level of an oscillating current; determining a reference voltage corresponding to the voltage level of the oscillating current; calculating whether a voltage level of a rectified voltage corresponding to the oscillating current is greater than a determined reference voltage, and in response: when the voltage level of the rectified voltage is greater than the determined reference voltage: verifying that the voltage level of the rectified voltage continues to be greater than the determined reference voltage for a period of time; and in response, generating a dim operating mode command for a lamp control circuit to place the lamp in a dim operating mode; otherwise if the voltage level of the rectified voltage is not greater than the determined reference voltage for any portion of the period of time, continuing to monitor the voltage level of the oscillating current; when the voltage level of the rectified voltage is not greater than the determined reference voltage: verifying that the voltage level of the rectified voltage continues to be not greater than the determined reference voltage for the period of time; in response, determining whether an indication exists for operating the lamp in the dim operating mode; wherein if the indication to operate in the dim operating mode exists, generating a dim operating mode command for a lamp control circuit to place the lamp in a dim operating mode; wherein if the indication to operate in the dim operating mode does not exist, generating a normal operating mode command for the lamp control circuit to place the lamp in a normal operating mode; otherwise, if the voltage level of the rectified voltage is greater than the determined reference voltage for any portion of the period of time, continuing to monitor the voltage level of the oscillating current.

BRIEF DESCRIPTION OF THE DRAWINGS

The foregoing and other objects, features, and advantages disclosed herein will be apparent from the following description of particular embodiments disclosed herein, as illustrated in the accompanying drawings in which like reference characters refer to the same parts through the different views. The drawings are not necessarily to scale, emphasis instead being placed upon illustrating the principles disclosed herein.

DETAILED DESCRIPTION

Figure 1:
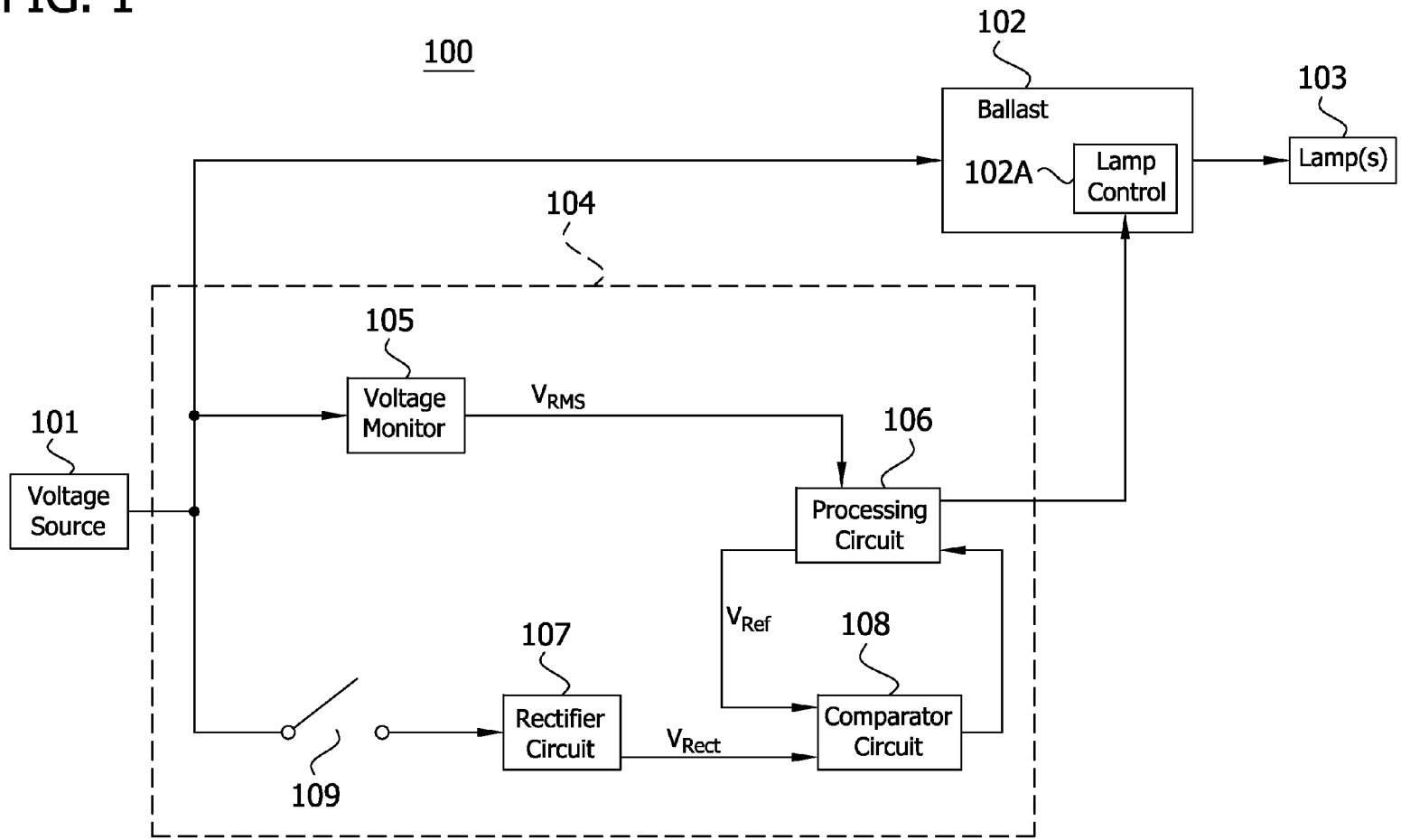
FIG. 1 is a block diagram of a system including a ballast and a step dimming interface according to embodiments disclosed herein.

FIG. 1 illustrates a step dimming interface system 100. The step dimming interface system 100 is for use with an input voltage source 101 that provides an oscillating current, such as but not limited to an alternating current (AC) power supply. The step dimming interface system 100 includes an electronic ballast 102 (also referred to throughout as the ballast 102) to energize at least one lamp 103 and a step dimming interface 104 that validates the dim mode, providing higher immunity in noisy environments. In some embodiments, the ballast 102 is an outdoor electronic ballast capable of operating between 0 and 10 volts and includes a step dimming feature. In other embodiments, the ballast 102 is used in street lighting applications to operate gas discharge lamps, such as but not limited to metal-halide lamps and/or high-pressure sodium lamps, or in other lighting applications to operate low pressure gas discharge lamps. In other embodiments, the ballast 102 is the current-limiting resistor (also known as a ballast resistor) of a driver for a lighting device including one or more solid state light sources. In some embodiments, the lamp(s) 103 are fluorescent lamps, while in some embodiment, the lamp(s) 103 are lighting devices including one or more solid state light sources. However, it is contemplated that other types of lamps may be used as well.

The ballast 102 includes a voltage input port adapted for connecting to the voltage source 101 and an output port that connects to the lamp(s) 103. The ballast 102 also includes a lamp control circuit 102A, which receives a mode command from a processing circuit 106 for altering the power level applied to the lamp(s) 103 between a level corresponding to a dim operating mode and a level corresponding to a normal operating mode. In some embodiments, power applied to the lamp(s) 103 in the dim operating mode may be 30% to 70% of the power applied in the normal operating mode.

The step dimming interface 104 is responsive to user input to control when the lamp(s) 103 operates in either a normal mode or a dim mode. The step dimming interface 104 is a low-cost step dimming interface that efficiently improves the noise immunity for universal voltage electronic dimmable ballasts or universal LED dimmable drivers. In contrast to noise-susceptible interfaces that use a high impedance network and an integrator filter to measure the average voltage, the step dimming interface 104 is more robust in noisy environments. The step dimming interface 104 includes a voltage monitor 105, a processing circuit 106, a rectifier circuit 107, a comparator circuit 109, and a user input port 109.

The voltage monitor 105 includes a voltage input port adapted for connecting to the voltage source 101 for receiving and monitoring the oscillating current. The voltage monitor 105 has an output port providing a voltage level that is the voltage level of the monitored oscillating current. For example, in some embodiments, the voltage monitor 105 is an analog to digital converter voltage monitor available from as part of a microcontroller or as a stand alone component. In some embodiments, the voltage level that is provided by the voltage monitor 105 is the root mean square (RMS) value of the oscillating current signal generated by the voltage source 101. Thus, the voltage monitor 105 measures the voltage level of the voltage source 101 and generates a corresponding voltage level $V_{RMS}$ indicative of the measured voltage level.

The rectifier circuit 107 includes a voltage input port adapted for connecting to the voltage source 101 for receiving the oscillating current and an output port connected to a comparator circuit 108. The output port of the rectifier circuit 107 provides a rectified voltage $V_{Rect}$ indicative of the oscillating current to the comparator circuit 108. The user input port 109 is adapted to be connected between the voltage source 101 and the rectifier circuit 107. The user input port 109 receives user input that indicates if the lamp(s) 103 are to be selectively energized at a dimmed power level or at the normal power level. Thus, the rectifier circuit 107 is responsive to user input for selectively energizing the lamp(s) 103 in either a dim mode or a normal mode. In some embodiments, the user input port 109 is a switch. The rectifier circuit 107 receives the oscillating current from the voltage source 101 when the switch is closed by the user and provides a corresponding rectified voltage $V_{Rect}$. In some embodiments, the corresponding rectified voltage $V_{Rect}$ is a half-wave rectified voltage.

The processing circuit 106 is connected to the output port of the voltage monitor 105 and to the output port of the comparator circuit 108, and this includes two inputs. The processing circuit 106 is also connected to an input port of the comparator circuit 108 and the input port of the lamp control circuit 102A, and thus includes two outputs. In some embodiments, the processing circuit 106 is a microcontroller or a microprocessor. In some embodiments, the processing circuit 106 is a ballast for a gas discharge lamp or a controller for driver for one or more solid state light sources.

The comparator circuit 108 includes a first voltage input port connected to the rectifier circuit 107, a second voltage input port connected to the processing circuit 106, and a voltage output port connected to the processing circuit 106. In some embodiments, the comparator circuit 108 is an internal comparator, while in other embodiments, the comparator circuit 108 is an external comparator, available from a microcontroller, such as but not limited to the AT90PWM81, as a peripheral. The comparator circuit 108 receives the rectified voltage $V_{Rect}$ from the rectifier circuit 107 and the reference voltage $V_{Ref}$ from the processing circuit 106 and compares the voltage levels of these. When the rectified voltage $V_{Rect}$ is greater than the reference voltage $V_{Ref}$, the comparator circuit 108 generates a compared voltage at a first level. When the rectified voltage $V_{Rect}$ is less than the reference voltage $V_{Ref}$, the comparator circuit generates a compared voltage at a second level, such that the change in levels appears to be a pulse. FIGS. 7-13 include waveforms illustrating the dynamic step dimming interface functionality.

In some embodiments, the compared voltage generated by the comparator circuit 108 is a square wave, that is, a sequence of one or more pulses. The processing circuit 106 receives the one or more pulses and when a number of pulses are accumulated over a certain period of time corresponding to a preset period of time, the processing circuit 106 produces a command indicating to the lamp control circuit 102A that the lamp(s) 103 should be placed at the dimming power level (i.e., enter the dim operating mode). For example, if the frequency of the one or more pulses is 20 Hz, and the preset period of time is two seconds, 40 received pulses would cause the processing circuit 106 to produce a command indicating to the lamp control circuit 102A that the lamp(s) 103 should be placed at the dimming power level. An absence of pulses over a certain period of time, e.g., less than 40 pulses in two seconds, the processing circuit 106 produces a command indicating to the lamp control circuit 102A that the lamp(s) 103 should be placed in the normal power mode. Thus, the command from the comparator circuit 108 is digitally validated by the processing circuit 106 to verify whether or not operator input has been provided to change the operating mode of the lamp(s) 103. This validation is accomplished by creating a time delay between the first indication of a mode change request and the generation of a mode command to the lamp control circuit 102A. The validation delay period confirms the user input during the time delay and/or prevents an erroneous mode change from occurring due to induced noise on the step dimming interface 104, an intermittent voltage source connection, variations in the voltage source 101, or combinations thereof. In some embodiments, the default operating mode of the lamp(s) 103 is the normal operating mode, and in some embodiments, the default operating mode of the lamp(s) 103 is another operating mode.

Figure 2:
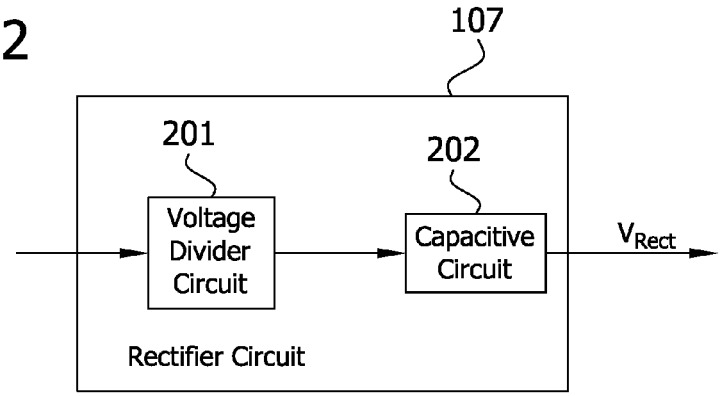
FIG. 2 is a block diagram of a rectifier circuit of the step dimming interface of FIG. 1 according to embodiments disclosed herein.

FIG. 2 illustrates the rectifier circuit 107 of FIG. 1, configured to produce the rectified voltage $V_{Rect}$ in greater detail. In FIG. 2, the rectifier circuit 107 utilizes a voltage divider circuit 201 and a capacitive circuit 202 to produce the rectified voltage $V_{Rect}$. In contrast to using a transformer, the voltage divider circuit 201 provides a low-cost device to reduce the oscillating current from the voltage source 101 of FIG. 1 for use by the step dimming interface 104 of FIG. 1.

Figure 3:
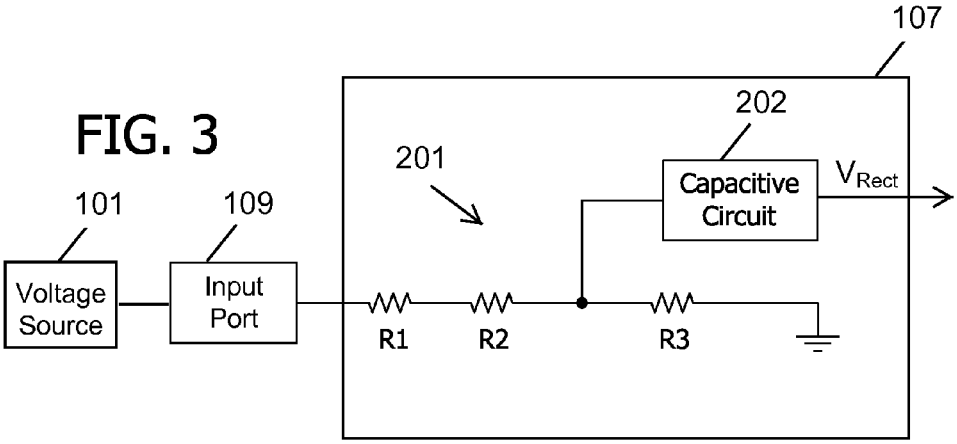
FIG. 3 is a schematic diagram of a voltage divider circuit according to embodiments disclosed herein.

FIG. 3 shows the voltage source 101, the input port 109, and the rectifier circuit 107, including the voltage divider circuit 201 in greater detail, and the capacitive circuit 202. In FIG. 3, the voltage divider circuit 201 is comprised of at least three resistors R1, R2, R3 connected in series between the input port 109 and ground, with the capacitive circuit 202 connected between the resistor R2 and the resistor R3. In some embodiments, the nominal values of the three resistors R1, R2, R3 are, for example, 220 kiloohms (kΩ), 220 kΩ, and 2.2 kΩ. The actual values of the three resistors R1, R2, R3 may, and in some embodiments does, vary as much as 5%, and thus give rise to minimum and maximum values. Table 1 below indicates, through exemplary values, that this variance in resistive values does not alter the selection of the appropriate reference voltage $V_{Ref}$ level, as explained in greater detail below.

TABLE 1

| | R1 (kΩ) | R2 (kΩ) | R3 (kΩ) | $V_{RMS}$: 108 — | 120 — | 220 — | 277 — | 305 — |
|---|---|---|---|---|---|---|---|---|
| Minimum | 231 | 231 | 2.09 | 0.688 | 0.764 | 1.40 | 1.764 | 1.942 |
| Nominal | 220 | 220 | 2.20 | 0.760 | 0.844 | 1.55 | 1.949 | 2.146 |
| Maximum | 209 | 209 | 2.31 | 0.839 | 0.933 | 1.70 | 2.153 | 2.371 |
| | | | $V_{Ref}$: | 0.4 | 0.4 | 0.8 | 1.6 | 1.6 |

Figure 4:
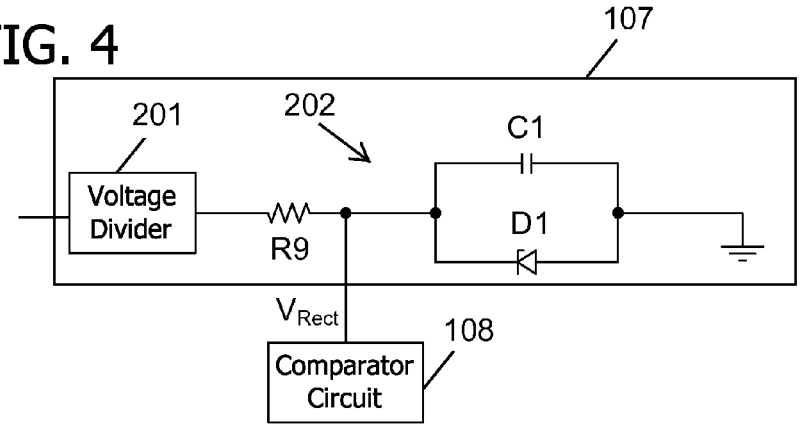
FIG. 4 is a schematic diagram of a capacitive circuit according to embodiments disclosed herein.

FIG. 4 shows the rectifier circuit 107, including the voltage divider circuit 201 and the capacitive circuit 202 in greater detail, along with the comparator circuit 108. The capacitive circuit 202 of FIG. 4 is comprised of a diode D1 connected in parallel with a capacitor C1, and the parallel combination of the diode D1 and the capacitor C1 connected in series with a resistor R9. The voltage divider circuit 201 is also connected to the resistor R9, and the comparator circuit 108 is connected between the resistor R9 and the parallel combination of the diode D1 and the capacitor C1. The capacitive circuit 202 functions as a protection against voltage surges as well as a filter to remove unwanted noise at high frequencies.

Figure 5:
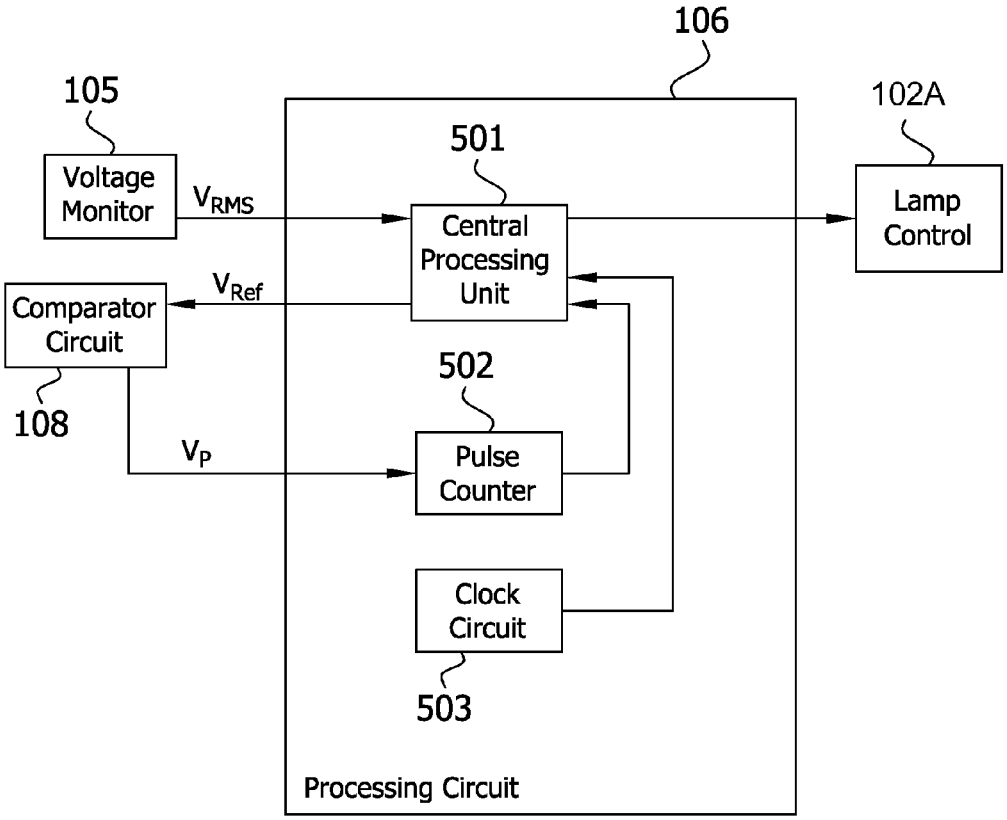
FIG. 5 is a block diagram of a processing circuit of the step dimming interface of FIG. 1 according to embodiments disclosed herein.

FIG. 5 illustrates the processing circuit 106 in greater detail. In FIG. 5, the processing circuit 106 utilizes a central processing unit 501, a pulse counter 502, and a clock circuit 503. In some embodiments, the central processing unit 501 is a microprocessor or a microcontroller. The pulse counter 502 is used to count the number of pulses present in the one or more pulses generated by the comparator circuit 108. The clock circuit is used to provide a reference time in which to measure the pulses, or lack of pulses, in the one or more pulses generated by the comparator circuit 108.

The central processing unit 501 receives the voltage level $V_{RMS}$ from the voltage monitor 105 and calculates a peak voltage $V_{Peak}$ of the oscillating current generated by the voltage source 101, such as but not limited to by multiplying the voltage level $V_{RMS}$ by a factor (e.g., the square root of two). Using the calculated peak voltage $V_{Peak}$, the central processing unit 501 determines the reference voltage level $V_{Ref}$, which is provided to the comparator circuit 108. The comparator circuit 108 also receives the rectified voltage $V_{Rect}$ from the rectified circuit 107. In embodiments where the rectifier circuit 107 includes a voltage divider 201 as shown in FIG. 3, $V_{Rect}$ may be determined by the central processing unit 501 by using the following formula: $V_{Rect}$=(R3/(R1+R2+R3))($V_{Peak}$). The processing circuit 106 need not calculate $V_{Rect}$. Instead, this calculation may be made during analysis by the fabricators of the system 100 and used to calculate $V_{rect}$ over a universal range (e.g., 120V-277V) to therein determine the logic to be used for deciding what the reference voltage $V_{ref}$ should be.

Using the voltage level $V_{RMS}$ output by the voltage monitor 105, the central processing unit 501 determines the reference voltage $V_{Ref}$ corresponding to the received rectified voltage $V_{Rect}$. In some embodiments, the central processing unit 501 selects from a number of programmable reference voltage $V_{Ref}$ levels stored in a memory (not shown in FIG. 5) that is part of, or external to and in communication with, the central processing unit 501. In some embodiments, the programmable reference voltage $V_{Ref}$ levels are 0.4 V, 0.8 V, 1.2 V, and 1.6 V, and the central processing unit 501 selects a reference voltage $V_{Ref}$ that is in close proximity to, but not greater than, the calculated peak voltage $V_{Peak}$ of the oscillating current of the voltage source 101. For example, if the voltage level $V_{RMS}$ is 110 V, the calculated peak voltage $V_{Peak}$ will be 155.6 V, and the rectified voltage $V_{Rect}$ will be 0.77 V, which is the peak of a half-wave rectified signal.

The central processing unit 501 will then select a reference voltage $V_{Ref}$ of 0.4 V. Table 2 illustrates one example of the relationship among various voltage levels $V_{RMS}$, peak voltages $V_{Peak}$, and rectified voltages $V_{Rect}$ with the four reference voltage $V_{Ref}$ levels highlighted.

TABLE 2

| $V_{RMS}$ (V) | $V_{Peak}$ (V) | $V_{Rect}$ (V) |
|---|---|---|
| 55 | 77.8 | 0.39 |
| 58 | 82.0 | 0.41 |
| 60 | 84.9 | 0.42 |
| 70 | 99.0 | 0.49 |
| 80 | 113.1 | 0.56 |
| 90 | 127.3 | 0.63 |
| 100 | 141.4 | 0.70 |
| 110 | 155.6 | 0.77 |
| 115 | 162.6 | 0.81 |
| 120 | 169.7 | 0.84 |
| 130 | 183.8 | 0.91 |
| 150 | 212.1 | 1.06 |
| 160 | 226.3 | 1.13 |
| 170 | 240.4 | 1.20 |
| 180 | 254.6 | 1.27 |
| 208 | 294.2 | 1.46 |
| 220 | 311.1 | 1.55 |
| 228 | 322.4 | 1.60 |
| 230 | 325.3 | 1.62 |
| 240 | 339.4 | 1.69 |
| 250 | 353.6 | 1.76 |
| 260 | 367.7 | 1.83 |
| 270 | 381.8 | 1.90 |
| 277 | 391.7 | 1.95 |
| 305 | 431.3 | 2.15 |

In some embodiments, the reference voltage $V_{Ref}$ levels are selected according to hexadecimal values entered into registers (i.e., memory) within the processing circuit 106. Table 3 illustrates an examples of such hexadecimal values and the corresponding reference voltage $V_{Ref}$ levels.

TABLE 3

| Processing Circuit Internal $V_{Ref}$(V) | Register Value | Internal Divider | $V_{Ref}$(V) |
|---|---|---|---|
| 2.56 | 88 | Internal $V_{Ref}$/6.4 | 0.40 |
| 2.56 | 89 | Internal $V_{Ref}$/3.2 | 0.80 |
| 2.56 | 8A | Internal $V_{Ref}$/2.13 | 1.20 |
| 2.56 | 8B | Internal $V_{Ref}$/1.60 | 1.60 |

Table 3 may be implemented by a programming routine, such as:

IF Vrms>240, THEN Select 8B (1.6), ELSE
IF Vrms>180, THEN Select 8A (1.20), ELSE
IF Vrms>120, THEN Select 89 (0.8), ELSE
Select 88 (0.4).

A dedicated comparator control register is configured to set up the internal reference voltage. The division values are fixed and depend on the microcontroller type being used, such as but not limited to the AT90PWM81 microcontroller from ATMEL. The division values are selected by changing three binary bits in the comparator control register.

Figure 6:
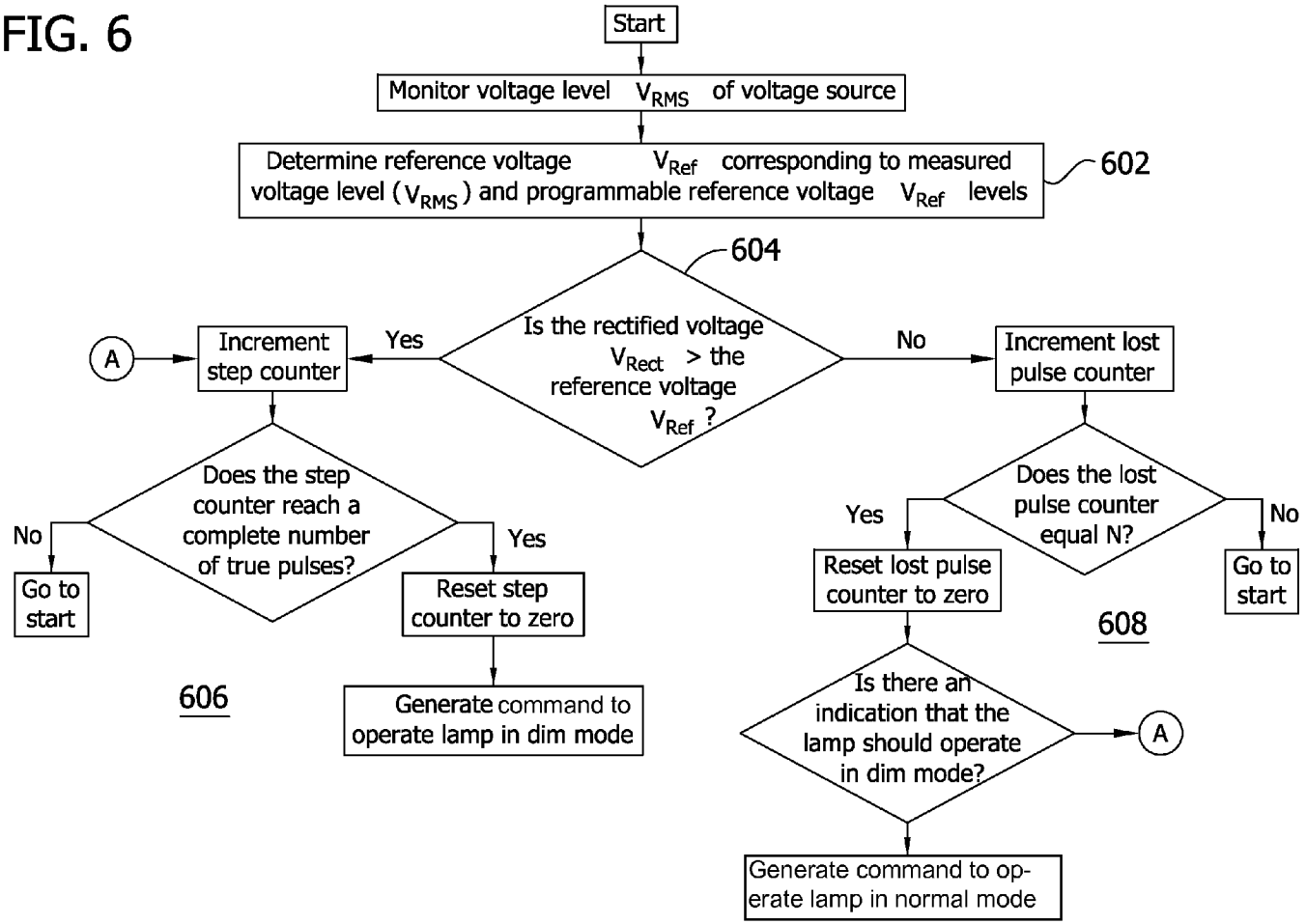
FIG. 6 is a flowchart illustrating a method of operating a step dimming interface according to embodiments disclosed herein.

A flowchart is shown in FIG. 6. The rectangular and diamond elements are herein denoted "processing blocks" and represent computer software instructions or groups of instructions. Alternatively, the processing blocks represent steps performed by functionally equivalent circuits such as a microprocessor, microcontroller, digital signal processor circuit, or an application specific integrated circuit (ASIC), or in embodiments described herein, by the processing circuit 106 and its related components. The flowcharts do not depict the syntax of any particular programming language. Rather, the flowcharts illustrate the functional information one of ordinary skill in the art requires to fabricate circuits or to generate computer software to perform the processing required in accordance with the present invention. It should be noted that many routine program elements, such as initialization of loops and variables and the use of temporary variables are not shown. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order. More specifically, FIG. 6 illustrates a method of operations performed by the processing circuit 106.

As described above and below, the operations may be, and in some embodiments are, computer program code and/or instructions stored within the processing circuit 106 and/or external thereto, that, when executed within the processing circuit 106, cause the system to perform the operations described herein. The processing circuit 106 first selects the reference voltage $V_{Ref}$ level at 602. Next, the processing circuit receives at 604 the one or more pulses generated by the comparator circuit 108 to determine whether a pulse event occurs. A pulse event occurs when the comparator circuit 108 generates one or more pulses that changes between two levels, as described above. If there are one or more pulses, the processing circuit 106 during a time delay counts the one or more pulses as indicated by steps 606 in order to determine whether the user input indicates a dimming operation mode for the lamp(s) 103. If there is an absence of one or more pulses, the processing circuit 106 during a time delay measures the absence of pulses as indicated by steps 608 in order to determine whether the user input indicates a normal operating mode for the lamp(s) 103.

In some embodiments, the operation of the processing circuit 106 is implemented by a memory and a processor executing processor executable instructions stored in the memory. The instructions first monitor the voltage level $V_{RMS}$ produced by the voltage monitor 105 that corresponds to the voltage level of the oscillating current. Next, the instructions determine which programmable reference voltage $V_{Ref}$ level corresponds to the monitored voltage level $V_{RMS}$, as indicated by step 602. A comparison determines whether the rectified voltage $V_{Rect}$ is greater than the determined reference voltage $V_{Ref}$, as indicated by step 604. If the rectified voltage $V_{Rect}$ is greater than the determined reference voltage $V_{Ref}$, as indicated by steps 606, then the processor waits a period of time to ensure that the rectified voltage $V_{Rect}$ stays greater than the determined reference voltage $V_{Ref}$ for the entire period of time. If the rectified voltage $V_{Rect}$ is greater than the reference voltage $V_{Ref}$ for the entire period of time, then the processing circuit 106 (which includes the processor and the memory, or is otherwise connected to the memory) generates a mode command indicating to the lamp control circuit 102A that the lamp(s) 103 should be energized in the dim mode. However, if the rectified voltage $V_{Rect}$ becomes less than the reference voltage $V_{Ref}$ at some point during the period of time, then the processor restarts the monitoring process. If initially, the rectified $V_{Rect}$ is not greater than the reference voltage $V_{Ref}$, as indicated by steps 608, then the processor waits a period of time to ensure that the reference voltage $V_{Ref}$ stays greater than the rectified $V_{Rect}$ for the entire period of time. If the reference voltage $V_{Ref}$ stays greater than the rectified voltage $V_{Rect}$ for the entire period of time, then the processor determines whether there is any indication that the lamp(s) 103 should be energized in the dim mode. If there is an indication that the lamp(s) 103 should be energized in the dim mode, then the processor executes the instructions corresponding to the situation where the rectified voltage $V_{Rect}$ is greater than the reference voltage $V_{Ref}$, as described above. If there is not an indication that the lamp(s) 103 should be energized in the dim mode, then the processing circuit 106 generates a mode command indicating to the lamp control circuit 102A that the lamp(s) 103 should be energized in the normal mode. If the rectified voltage $V_{Rect}$ becomes greater than the reference voltage $V_{Ref}$ at some point during the period of time, then the processor restarts the monitoring process.

FIGS. 7-13 are waveforms illustrating the functionality of the dynamic step dimming interface of FIGS. 1-6.

Figure 7:
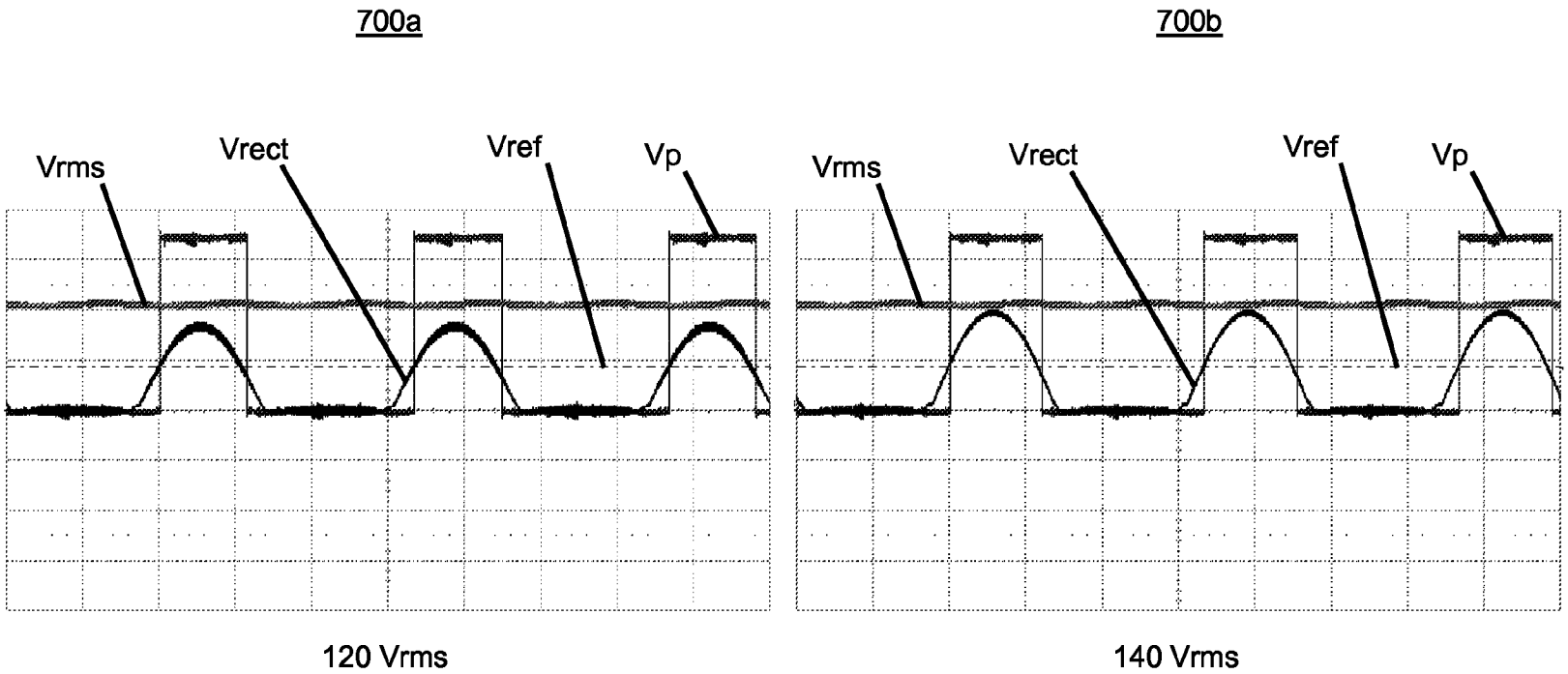
FIGS. 7-13 are waveforms illustrating functionality of the dynamic step dimming interface of FIGS. 1-6 according to embodiments disclosed herein.
Figure 8:
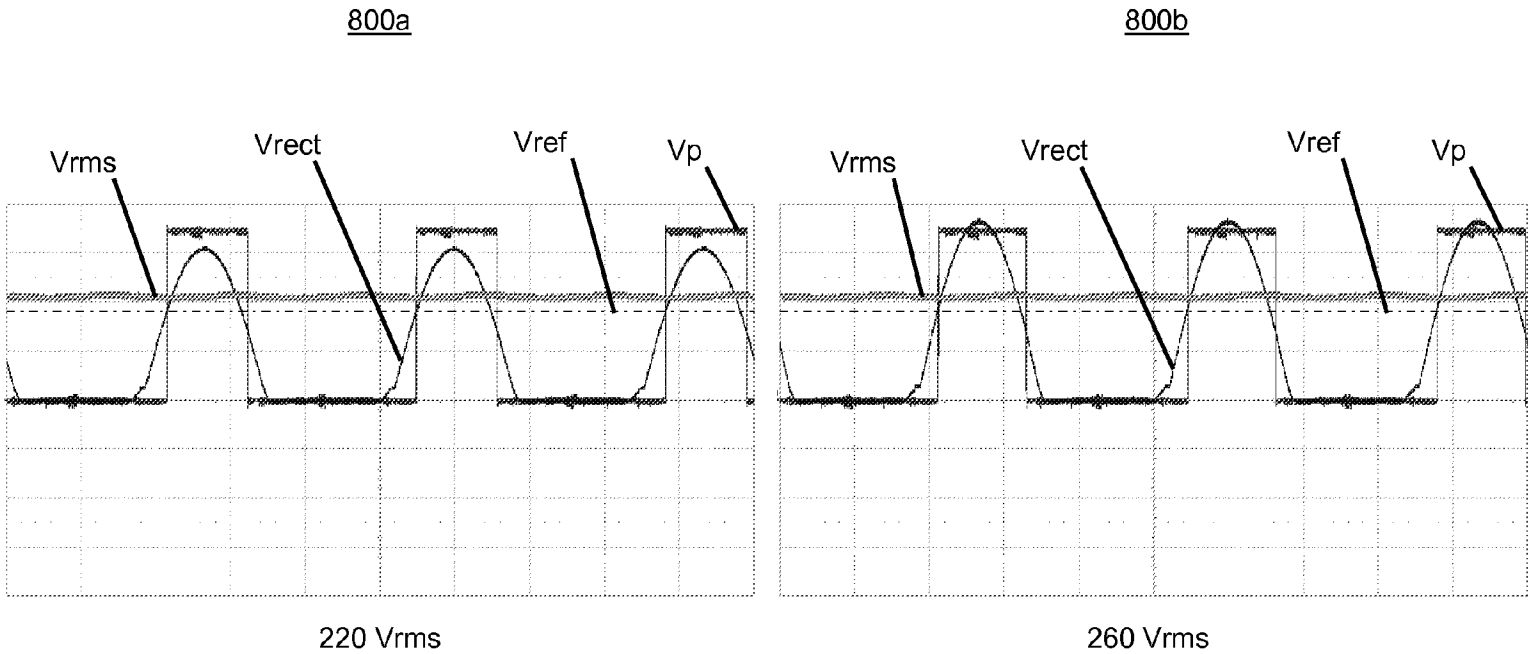
Figure 9:
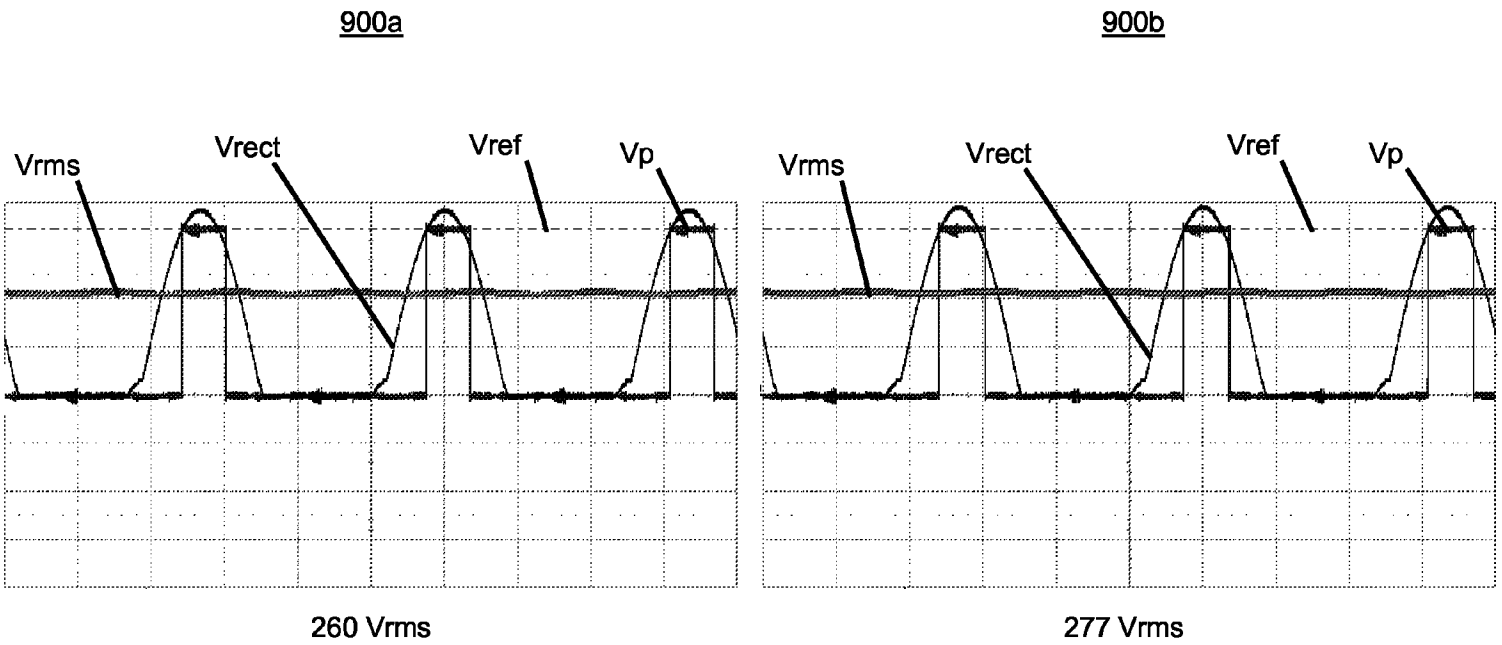

More particularly, FIGS. 7-9 are snapshots of waveforms 700*a*, 700*b*, 800*a*, 800*b*, 900*a*, 900*b* illustrating what occurs when the comparator circuit 108 receives a reference voltage Vref from the processing circuit 106 and a rectified voltage Vrect from the rectifier circuit 107, depending on the voltage level Vrms output by the voltage monitor 105, showing in detail the operation of the dynamic step dimming interface.

In FIG. 7, the waveform 700*a* has a voltage level Vrms of 120 Vrms, while the waveform 700*b* has a voltage level Vrms of 140 Vrms, respectively. Both of these are above a threshold value of the reference voltage Vref, which is 0.4 V. An output signal Vp of the comparator circuit 108 is a square pulse waveform that is input to a pulse counter, such as but not limited to the pulse counter 502 of FIG. 5. A peak of the output signal Vp is greater than a peak of the rectified voltage Vrect in both waveforms 700*a*, 700*b*. Similarly, in FIG. 8, the waveform 800*a* has a voltage level Vrms of 220 Vrms, while the waveform 800*b* has a voltage level Vrms of 260 Vrms, respectively, which are again both above a threshold value of the reference voltage Vref, which is 0.8 V. However, in FIG. 8, while a peak of the output signal Vp is greater than a peak of the rectified voltage Vrect in the waveform 800*a*, the peak of the rectified voltage Vrect is greater than the peak of the output signal Vp in the waveform 800*b*.

In FIG. 9, the waveform 900*a* has a voltage level Vrms of 260 Vrms, and the waveform 900*b* has a voltage level Vrms of 277 Vrms, which are both above a threshold value of the reference voltage Vref, which is substantially 1.6V. In the waveforms 900*a* and 900*b*, the output signal Vp has a peak value corresponding to the reference voltage Vref, and the rectified voltage Vrect exceeds this peak value.

Figure 10:
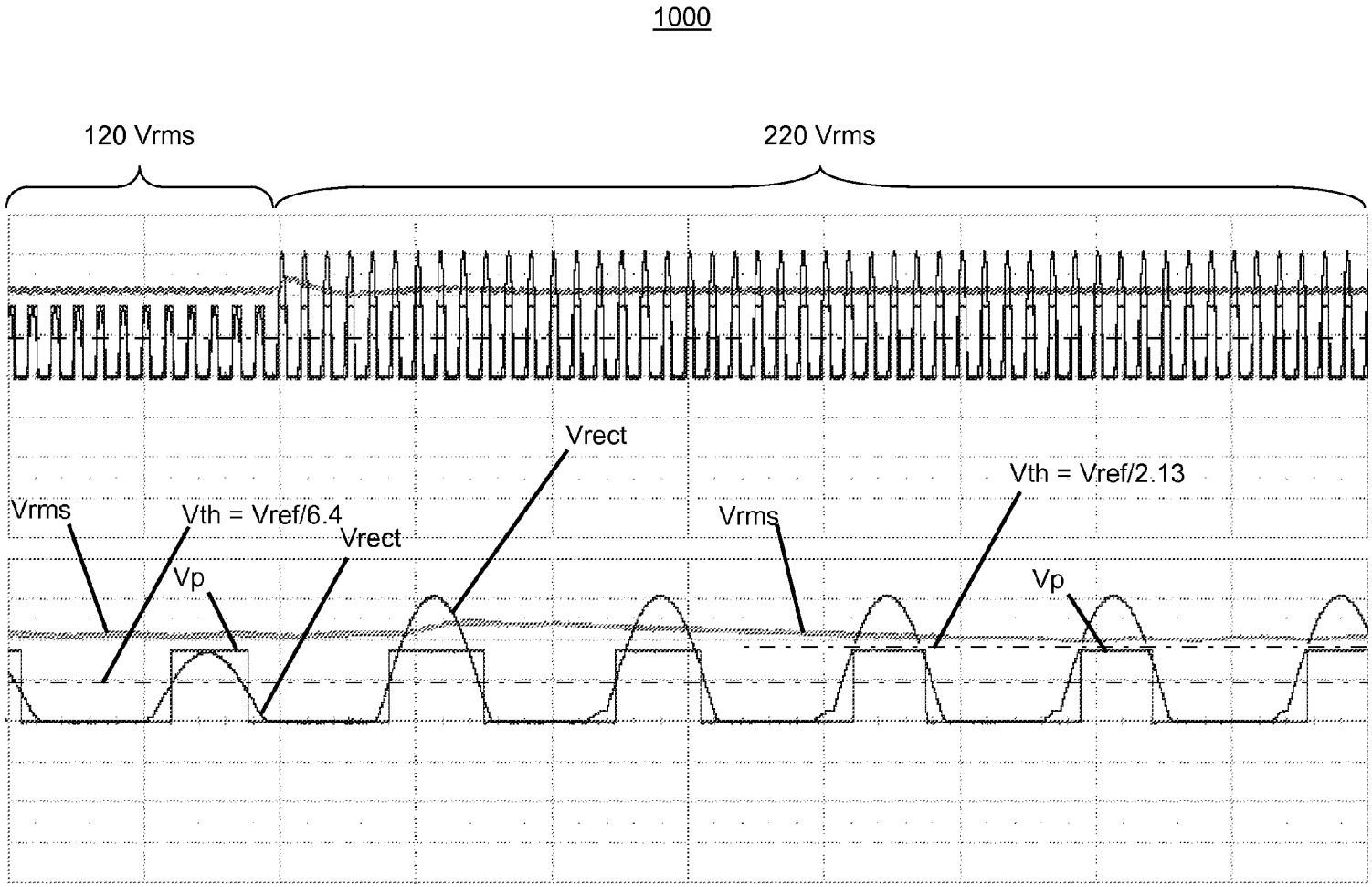
Figure 11:
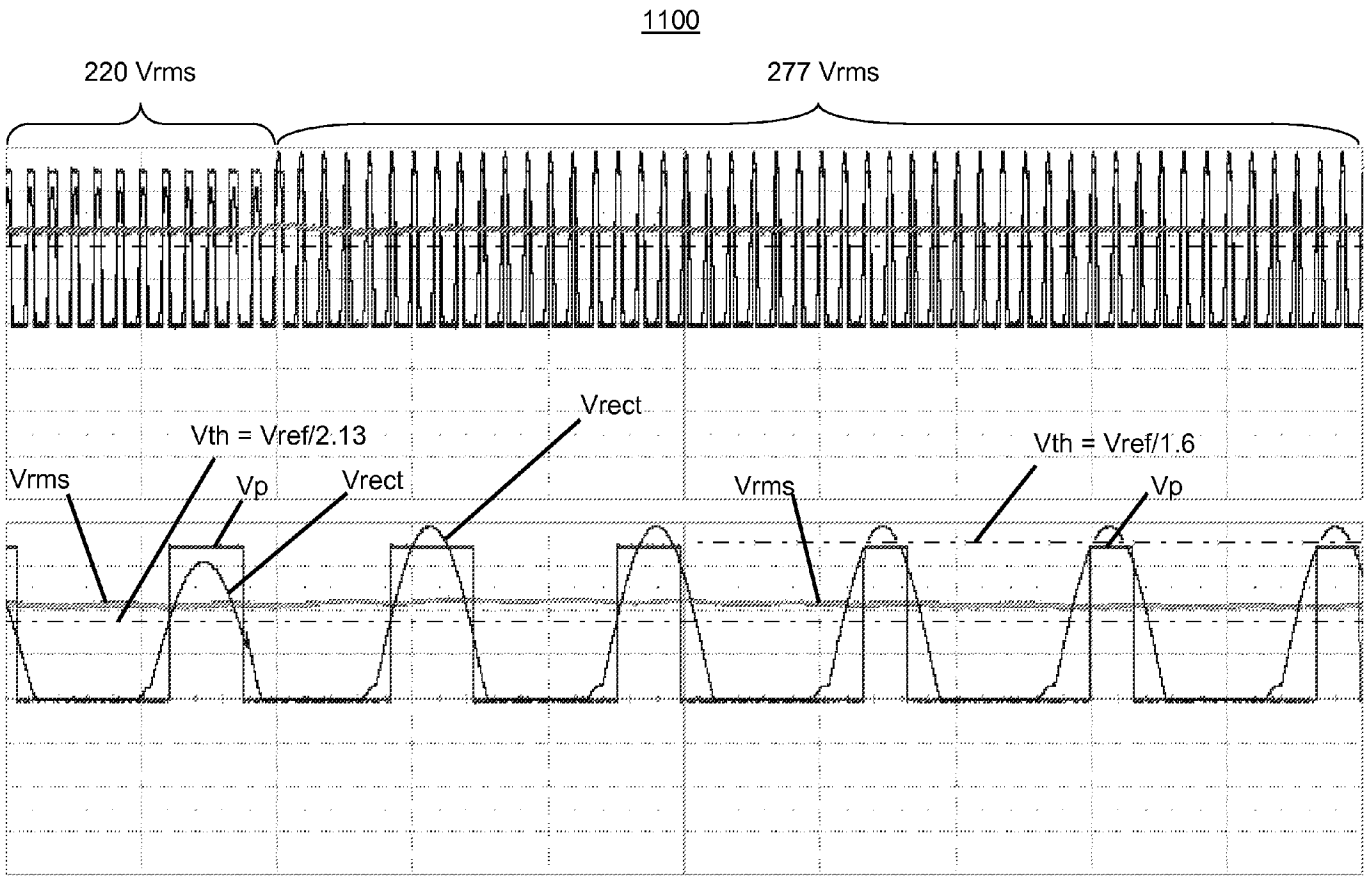

FIGS. 10 and 11 are snapshots of waveforms 1000, 1100 illustrating the response of the dynamic step dimming interface versus voltage transitions, more particularly when there is an increase, potentially a sudden increase, in the voltage transition. Voltage transitions are fixed from low to high (emulating a sudden rising voltage). In the waveform 1000, pulses Vp output by the comparator 106 are not lost, because the reference voltage Vref is below the rectified voltage Vrect, which transitions due to the change in the voltage level Vrms from 120 Vrms to 220 Vrms. The processing circuit 106 adjusts the reference voltage Vref from a threshold value of 0.4V (which is the reference voltage Vref divided by 6.4) to a threshold value of 1.2V (which is the reference voltage Vref divide by 2.13) when the line input voltage goes from 120 Vrms to 220 Vrms. Similarly, FIG. 11 shows the waveform 1100 having a change in reference voltage Vref when the lien input voltage goes from 220 Vrms to 270 Vrms, with a corresponding change in the rectified voltage Vrect.

Figure 12:
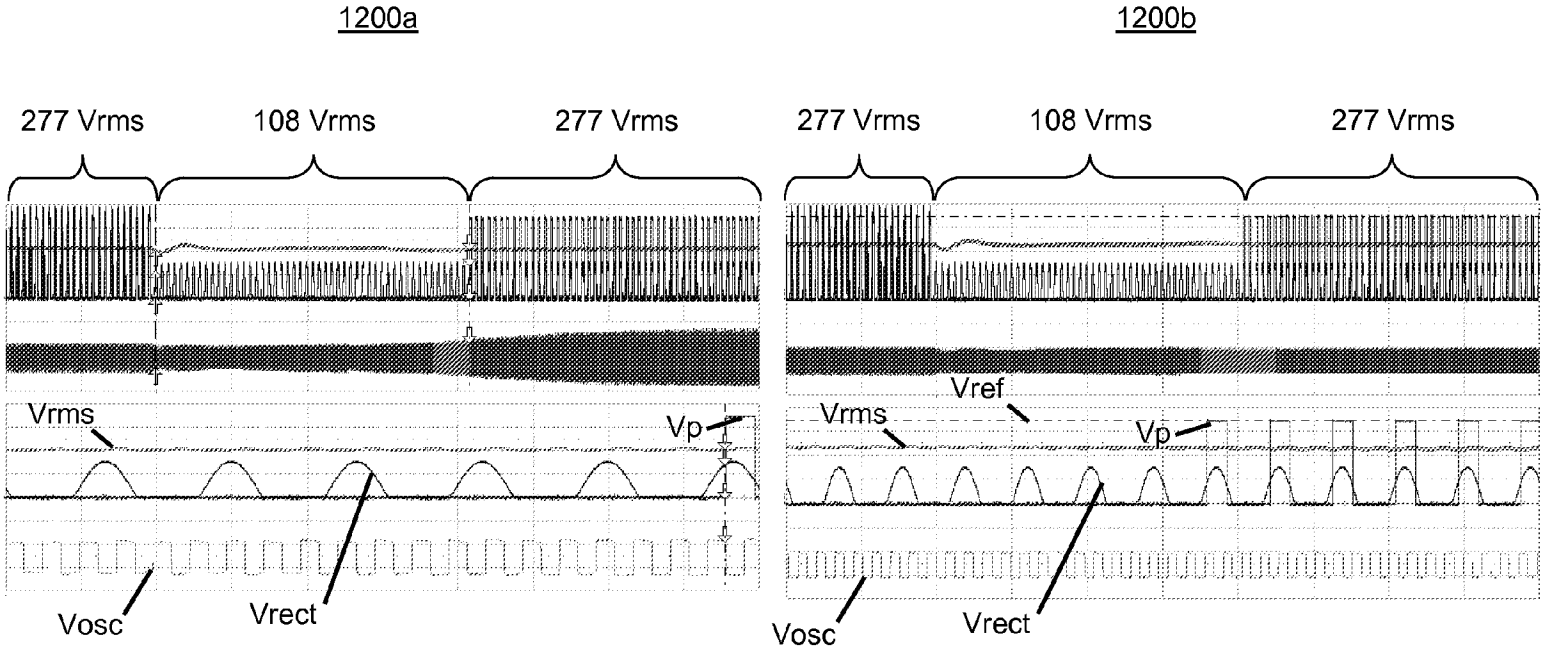
Figure 13:
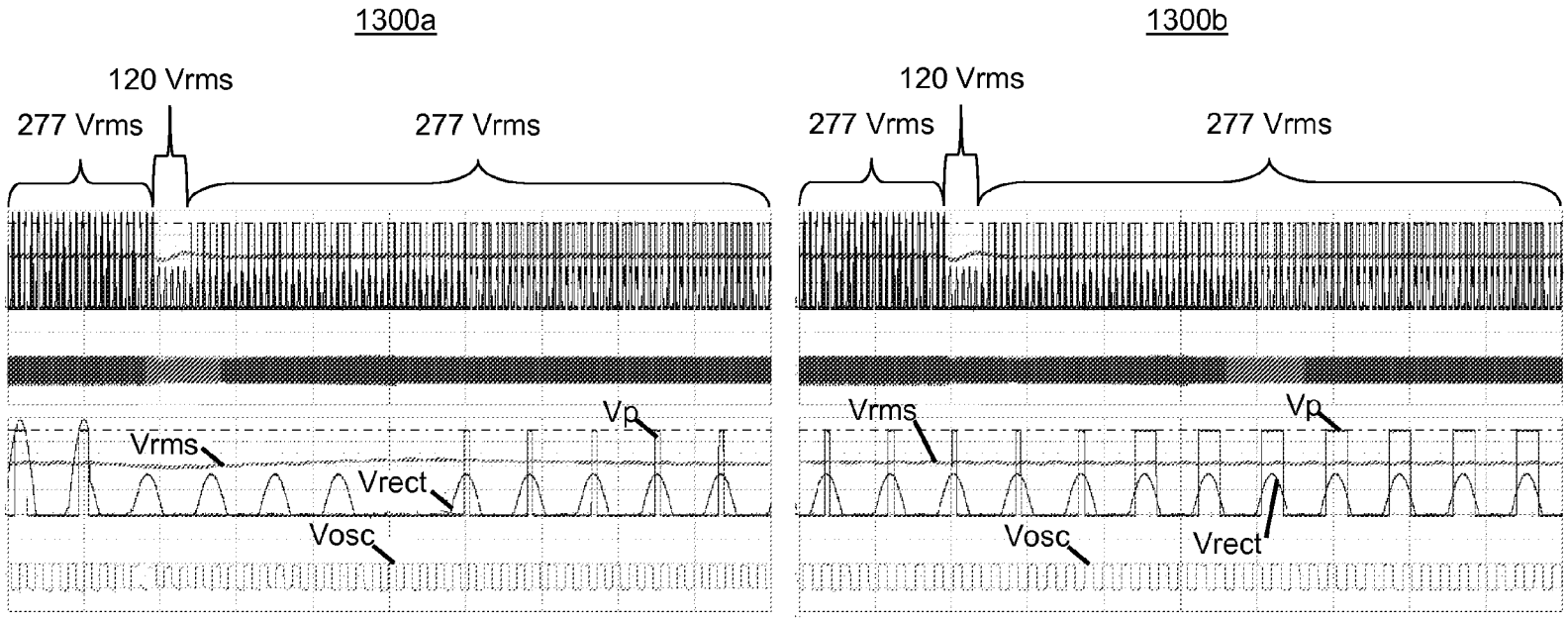

FIGS. 12 and 13 detail events due to sag voltage line conditions. In FIG. 12, a snapshot 1200*a* on the left shows what happens when the lost pulse counter 604 is not implemented. The lost pulse counter 604 avoids false triggering despite the sag voltage line condition. A snapshot 1200*b* on the right shows how the lost pulse counter 604 logic works. An oscillating waveform Vosc is related to the current on the lamp. In FIG. 12, the oscillating waveform Vosc in the snapshot 1200*a* shows the interface reverting back to a full power condition due to a false triggering detection. The oscillating waveform Vosc in the snapshot 1200*b* shows immunity to the transition, resulting in a true step dimming validation. Note that in both the snapshot 1200*a* and the snapshot 1200*b*, the voltage transitions from 277 Vrms to 108 Vrms and back to 277 V*rms*.

The sag voltage event illustrated in the waveforms 1300*a*, 1300*b* of FIG. 13 show how the processing circuit 106 automatically adjusts the reference voltage Vref when the line voltage (Vrms) changes from a high voltage level (277 Vrms) to a low voltage level (120 Vrms) and back again. The reference voltage Vref changes from 1.6 V to 0.8V and finally to 0.4 V, which in some embodiments is an optimal level.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer (s), workstation(s) (e.g., Sun, HP), personal digital assistant (s) (PDA(s)), handheld device(s) such as cellular telephone(s) or smart cellphone(s), laptop(s), handheld computer(s), or another device(s) capable of being integrated with a processor (s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A system, comprising:

a ballast configured to be connected a source of an oscillating current and to energize a lamp, wherein the ballast comprises a lamp control circuit responsive to a mode command indicating whether the lamp will be energized in one of a dim mode and a normal mode;

a voltage monitor comprising an input configured to receive the oscillating current and an output configured to indicate a voltage level of the oscillating current;

a processing circuit comprising a first input connected to the output of the voltage monitor to receive the voltage level therefrom, a second input, a first output connected to the lamp control circuit to provide the mode command thereto, wherein the mode command indicates one of a dim mode and a normal mode, and a second output to provide a reference voltage indicative of the voltage level of the oscillating current;

a rectifier circuit comprising an input configured to receive the oscillating current and an output configured to provide a rectified voltage indicative of the oscillating current, wherein the rectifier circuit is responsive to user input to selectively energize the lamp in one of a dim mode and a normal mode; and a comparator circuit comprising a first input connected to the rectifier circuit, a second input connected to the second output of the processing circuit, and an output connected to the second input of the processing circuit and configured to provide a compared voltage indicative of a power level applied to the lamp;

wherein the processing circuit is responsive to the compared voltage provided by the comparator circuit and is responsive to voltage level indicated by the voltage monitor to provide the mode command to the ballast.

2. The system of claim 1, wherein the rectifier circuit comprises:

a resistive voltage divider circuit to limit a peak voltage of the oscillating current; and a capacitive circuit to remove high-frequency noise in the rectifier voltage.

3. The system of claim 2, wherein the processing circuit is configured to average the compared voltage over a period of time.

4. The system of claim 3, wherein the period of time is between one second and four seconds.

5. The system of claim 1, wherein the processing circuit includes a time delay between receiving the compared voltage and providing the mode command indicating one of a dim mode and a normal mode.

6. The system of claim 5, wherein the processing circuit is configured to validate the user input during the time delay.

7. The system of claim 6, wherein the processing circuit is configured to validate the user input by confirming the user input during the time delay.

8. The system of claim 6, wherein the time delay is between one second and four seconds.

9. The system of claim 6, wherein the time delay is at least one second.

10. The system of claim 1, wherein the comparator circuit comprises an auto-programmable comparator circuit comprising an output configured to provide one or more pulses to the second input of the processing circuit.

11. The system of claim 10, wherein the processing circuit comprises:

a central processing unit comprising a first input connected to the output of the voltage monitor, a second input, a third input, a first output connected to the lamp control circuit to provide a mode command indicating that the lamp will be energize in one of a dim mode and a normal mode, and a second output to provide a reference voltage indicative of the voltage level of the oscillating current;

a pulse counter comprising an input to receive the one or more pulses from the auto-programmable comparator circuit and an output connected to the second input of the central processing unit to provide a second voltage indicative of the state of the lamp controlled by the lamp control circuit; and a clock circuit comprising an output connected to the third input of the central processing unit to provide a time reference for the one or more pulses;

wherein the central processing unit is responsive to the second voltage and to the time reference to provide the mode command.

12. A system, comprising:

a ballast configured to be connected to a source of an oscillating current and to energize a lamp, wherein the ballast comprises a lamp control circuit responsive to a mode command indicating whether the lamp will be energized in one of a dim mode and a normal mode;

a voltage monitor comprising an input configured to receive the oscillating current and an output configured to indicate a voltage level of the oscillating current signal;

a central processing circuit comprising a first input connected to the output of the voltage monitor, a second input, a third input, a first output connected to the lamp control circuit to provide a mode command indicating that the lamp will be energized in one of a dim mode and a normal mode, and a second output to provide a reference voltage indicative of the voltage level of the oscillating current;

a rectifier circuit comprising an input configured to receive the oscillating current, an output configured to provide a rectified voltage indicative of the oscillating current, a resistive voltage divider circuit to limit a peak voltage of the oscillating current, and a capacitive circuit to remove high-frequency noise;

an auto-programmable comparator circuit comprising a first input connected to the rectifier circuit, a second input connected to the second output of the central processing circuit, and an output configured to provide one or more pulses indicative of a power level applied to the lamp;

a pulse counter comprising an input to receive the one or more pulses from the auto-programmable comparator circuit and an output connected to the second input of the central processing circuit to provide a second voltage indicative of the state of the lamp controlled by the lamp control circuit; and a clock circuit comprising an output connected to the third input of the central processing circuit to provide a time reference for the one or more pulses;

wherein the central processing circuit is responsive to the one or more pulses and to the voltage level output by the voltage monitor to provide the mode command.

13. The system of claim 12, wherein the central processing circuit is configured to average the one or more pulses over a period of time.

14. The system of claim 13, wherein the period of time is between one second and four seconds.

15. The system of claim 12, wherein the central processing circuit includes a time delay between receiving the one or more pulses and providing the mode command indicating one of a dim mode and a normal mode.

16. The system of claim 15, wherein the central processing circuit is configured to validate the user input during the time delay by confirming the user input during the time delay.

17. The system of claim 16, wherein the time delay is between one second and four seconds.

18. A method of energizing a lamp in one of a dim mode and a normal mode, comprising:

monitoring a voltage level of an oscillating current;

determining a reference voltage corresponding to the voltage level of the oscillating current;

calculating whether a voltage level of a rectified voltage corresponding to the oscillating current is greater than a determined reference voltage, and in response:

when the voltage level of the rectified voltage is greater than the determined reference voltage:

verifying that the voltage level of the rectified voltage continues to be greater than the determined reference voltage for a period of time; and in response, generating a dim operating mode command for a lamp control circuit to place the lamp in a dim operating mode;

otherwise if the voltage level of the rectified voltage is not greater than the determined reference voltage for any portion of the period of time, continuing to monitor the voltage level of the oscillating current;

when the voltage level of the rectified voltage is not greater than the determined reference voltage:

verifying that the voltage level of the rectified voltage continues to be not greater than the determined reference voltage for the period of time;

in response, determining whether an indication exists for operating the lamp in the dim operating mode;

wherein if the indication to operate in the dim operating mode exists, generating a dim operating mode command for a lamp control circuit to place the lamp in a dim operating mode;

wherein if the indication to operate in the dim operating mode does not exist, generating a normal operating mode command for the lamp control circuit to place the lamp in a normal operating mode;

otherwise, if the voltage level of the rectified voltage is greater than the determined reference voltage for any portion of the period of time, continuing to monitor the voltage level of the oscillating current.

* * * * *